US009362685B2

(12) United States Patent
Lostoski et al.

(10) Patent No.: US 9,362,685 B2
(45) Date of Patent: Jun. 7, 2016

(54) CONTROL SYSTEM COMPONENTS WITH KEY

(71) Applicants: Douglas A. Lostoski, Richfield, OH (US); Sreenivasulu Reddy Gajjala, Mayfield Heights, OH (US)

(72) Inventors: Douglas A. Lostoski, Richfield, OH (US); Sreenivasulu Reddy Gajjala, Mayfield Heights, OH (US)

(73) Assignee: Rockwell Automation Asia Pacific Business Center PTE Ltd., Singapore (SG)

( * ) Notice: Subject to any disclaimer, the term of this patent is extended or adjusted under 35 U.S.C. 154(b) by 176 days.

(21) Appl. No.: 14/221,848

(22) Filed: Mar. 21, 2014

(65) Prior Publication Data

US 2015/0270652 A1 Sep. 24, 2015

(51) Int. Cl.

*H01R 13/64* (2006.01)
*H01R 13/66* (2006.01)
*H01R 9/26* (2006.01)

(52) U.S. Cl.

CPC ..... *H01R 13/6608* (2013.01); *H01R 9/2625* (2013.01); *H01R 13/64* (2013.01); *Y10T 29/49117* (2015.01)

(58) Field of Classification Search

CPC ..... H01R 13/64
USPC ..... 439/677, 680, 681
See application file for complete search history.

(56) References Cited

U.S. PATENT DOCUMENTS 5,603,641 A * 2/1997 Kuhn ..... H01R 13/64 439/680
6,302,745 B1 * 10/2001 Landis ..... H01R 13/6453 439/681
7,892,043 B1 * 2/2011 Orand ..... H01R 13/6453 439/681
8,241,063 B2 * 8/2012 Nagata ..... H01R 12/724 439/345
8,628,004 B2 1/2014 Vazach et al.

FOREIGN PATENT DOCUMENTS

EP 2 421 344 A2 2/2012

* cited by examiner

*Primary Examiner* — Tho D Ta
(74) *Attorney, Agent, or Firm* — Fay Sharpe LLP

(57) ABSTRACT

A system including a base mountable to a rail, the base including a receptacle for receiving an input/output (I/O) module, and an (I/O) module attachable to the base, the I/O module including communication circuitry disposed within a housing of the I/O module configured to communicate, via a terminal block, with one or more field devices configured to monitor and/or control an industrial automation process. The base and I/O module include mating male and female components, and the mating male and female components have a cross-sectional shape having a wedge portion and a radius portion, the wedge portion extending along a major portion of a midpoint axis bisecting the wedge portion and the radius portion.

17 Claims, 9 Drawing Sheets

| FEMALE KEY POSITION | MALE KEY POSITION | VOLUME OF INTERFERENCE ($mm^3$) | THICKNESS OF FEMALE KEY (mm) | AREA OF THE INTERFERENCE ($mm^2$) | TOTAL AREA OF THE CROSS SECTION OF MALE KEY ($mm^2$) | INTERFERENCE RATIO |
|---|---|---|---|---|---|---|
| 1 | 2 | 1.82 | 1 | 1.82 | 7.12 | 0.26 |
| 1 | 3 | 3.24 | 1 | 3.24 | 7.12 | 0.46 |
| 1 | 4 | 2.01 | 1 | 2.01 | 7.12 | 0.28 |
| 1 | 5 | 0.56 | 1 | 0.56 | 7.12 | 0.08 |
| 1 | 6 | 2.01 | 1 | 2.01 | 7.12 | 0.28 |
| 1 | 7 | 3.24 | 1 | 3.24 | 7.12 | 0.46 |
| 1 | 8 | 1.82 | 1 | 1.82 | 7.12 | 0.26 |

| FEMALE KEY POSITION | MALE KEY POSITION | VOLUME OF INTERFERENCE ($mm^3$) | THICKNESS OF FEMALE KEY (mm) | AREA OF THE INTERFERENCE ($mm^2$) | TOTAL AREA OF THE CROSS SECTION OF MALE KEY ($mm^2$) | INTERFERENCE RATIO |
|---|---|---|---|---|---|---|
| 1 | 2 | 2.29 | 1 | 2.29 | 7.27 | 0.31 |
| 1 | 3 | 1.51 | 1 | 1.51 | 7.27 | 0.21 |
| 1 | 4 | 0.555 | 1 | 0.555 | 7.27 | 0.08 |
| 1 | 5 | 2.61 | 1 | 2.61 | 7.27 | 0.36 |
| 1 | 6 | 0.566 | 1 | 0.566 | 7.27 | 0.08 |
| 1 | 7 | 1.51 | 1 | 1.51 | 7.27 | 0.21 |
| 1 | 8 | 2.29 | 1 | 2.29 | 7.27 | 0.31 |

| FEMALE KEY POSITION | MALE KEY POSITION | VOLUME OF INTERFERENCE ($mm^3$) | THICKNESS OF FEMALE KEY (mm) | AREA OF THE INTERFERENCE ($mm^2$) | TOTAL AREA OF THE CROSS SECTION OF MALE KEY ($mm^2$) | INTERFERENCE RATIO |
|---|---|---|---|---|---|---|
| 1 | 2 | 2.19 | 1 | 2.19 | 9.42 | 0.23 |
| 1 | 3 | 3.23 | 1 | 3.23 | 9.42 | 0.34 |
| 1 | 4 | 2.54 | 1 | 2.54 | 9.42 | 0.27 |
| 1 | 5 | 3.03 | 1 | 3.03 | 9.42 | 0.32 |
| 1 | 6 | 2.54 | 1 | 2.54 | 9.42 | 0.27 |
| 1 | 7 | 3.23 | 1 | 3.23 | 9.42 | 0.34 |
| 1 | 8 | 2.19 | 1 | 2.19 | 9.42 | 0.23 |

CONTROL SYSTEM COMPONENTS WITH KEY

BACKGROUND

The present exemplary embodiment relates to the field of automation control systems, such as those used in industrial and commercial settings. It finds particular application in conjunction with providing, accessing, configuring, operating, or interfacing with input/output (I/O) devices that are configured for coupling and interaction with an automation controller, and will be described with particular reference thereto. However, it is to be appreciated that the present exemplary embodiment is also amenable to other like applications.

Automation controllers are special purpose computers used for controlling industrial automation and the like. Under the direction of stored programs, a processor of the automation controller examines a series of inputs (e.g., electrical input signals to the automation controller) reflecting the status of a controlled process and changes outputs (e.g., electrical output signals from the automation controller) based on analysis and logic for affecting control of the controlled process. The stored control programs may be continuously executed in a series of execution cycles, executed periodically, or executed based on events. The inputs received by the automation controller from the controlled process and the outputs transmitted by the automation controller to the controlled process are normally passed through one or more I/O devices, which are components of an automation control system that serve as an electrical interface between the automation controller and the controlled process.

Traditional I/O devices typically include a base configured to couple the I/O device with a bus bar or the like, a terminal block for communicatively coupling the I/O device with field devices, and an I/O module that includes circuitry for performing communication functions and/or logic operations. During maintenance of the I/O devices, the I/O modules and/or the terminal blocks of the I/O devices may be removed from their respective bases to facilitate performing diagnostics and troubleshooting of the I/O devices. Sometimes, when the I/O modules and/or the terminal blocks are re-inserted into their respective bases (e.g., once maintenance has been completed), one or more of the I/O modules and/or terminal blocks may be inadvertently re-inserted into a base for which it was not intended. As such, inadvertent mismatches of I/O modules and terminal blocks may occur. As a result, unexpected control issues may arise due to such mismatches.

Past attempts to address the problem of inadvertent mismatching of I/O modules have included mechanical keying of I/O modules and bases. For example, an I/O module is provided with a female key component that is intended to mate only with a male key component on a base (or vice versa) with which the I/O module is intended to function. While these attempts have been successful to some extent, there remains room for improvement.

BRIEF DESCRIPTION

In accordance with one aspect, a system comprises a base mountable to a rail, the base including a receptacle for receiving an input/output (I/O) module, and an (I/O) module attachable to the base, the I/O module including communication circuitry disposed within a housing of the I/O module configured to communicate, via a terminal block, with one or more field devices configured to monitor and/or control an industrial automation process. The base and I/O module include mating male and female components, and the mating male and female components have a cross-sectional shape having a wedge portion and a radius portion, the wedge portion extending along a major portion of a midpoint axis bisecting the wedge portion and the radius portion.

The cross-sectional shape can be symmetrical about the midpoint axis bisecting the wedge portion and the radius portion. The male component can be supported by the base and the female component can be supported by the I/O module, and at least one of the male or female components can be rotatable relative to the base or I/O module by which it is supported. The at least one male or female component that is rotatable can be rotatable to eight discrete angular positions. Seven of the eight discrete angular positions can correspond to interference (non-mating) positions, each of the seven interference positions having an interference ratio of at least 0.15. The at least one male or female component that is rotatable can include a plurality of retention tangs adapted to cooperate with the base or I/O module to retain said component therein, and the base or I/O module can include a detent adapted to be received between adjacent retention tangs to restrict rotation of said component. The detent can include a flexible detent, the flexible detent configured to flex radially outwardly to permit rotation of said component when sufficient torque is applied thereto. The male component can include a cylindrical base, and a protrusion extending from the cylindrical base having the cross-sectional shape having the wedge portion and the radius portion. The cylindrical base can include an axial face having a plurality of markings surrounding the protrusion, the plurality of markings corresponding to a number of discrete angular positions of the male component.

In accordance with another aspect, a key system for control system components comprises mating male and female components, each of the male and female components being associated with a respective control system component, wherein the mating male and female components have a cross-sectional shape having a wedge portion and a radius portion, the wedge portion extending along a major portion of a midpoint axis bisecting the wedge portion and the radius portion. The cross-sectional shape can be symmetrical about the midpoint axis bisecting the wedge portion and the radius portion. The male component can be rotatable relative to the control system component with which it is associated. The male component can be rotatable to eight discrete angular positions. Seven of the eight discrete angular positions can correspond to interference (non-mating positions), each of the seven interference positions having an interference ratio of at least 0.15. The male component can be generally cylindrical and can include a plurality of circumferentially-spaced retention tangs adapted to cooperate with the associated control system component to retain the male component therein. The male key component can include at least one gap between adjacent circumferentially-spaced retention tangs, the gap adapted to receive a detent of the associated control system component to restrict rotation of said male component. Rotation of the male key component can urge the detent radially outwardly to permit rotation of the male key when sufficient torque is applied thereto. The male key component can include a cylindrical base, and a protrusion extending from the cylindrical base having the cross-sectional shape having the wedge portion and the radius portion. The cylindrical base can include an axial face having a plurality of markings surrounding the protrusion, the plurality of markings corresponding to a number of discrete angular positions of the male component.

In accordance with another aspect, a method comprises providing a first control system component having a rotatable male key with a cross-sectional shape having a wedge portion and radius portion, the wedge portion extending along a major portion of a midpoint axis bisecting the wedge portion and the radius portion, providing a second control system component having a fixed female key slot for receiving the male key of the first control system component when the first and second control system components are coupled, rotating the male key to match an angular position of the female key slot, and coupling the first and second control system components.

DETAILED DESCRIPTION

Figure 1:
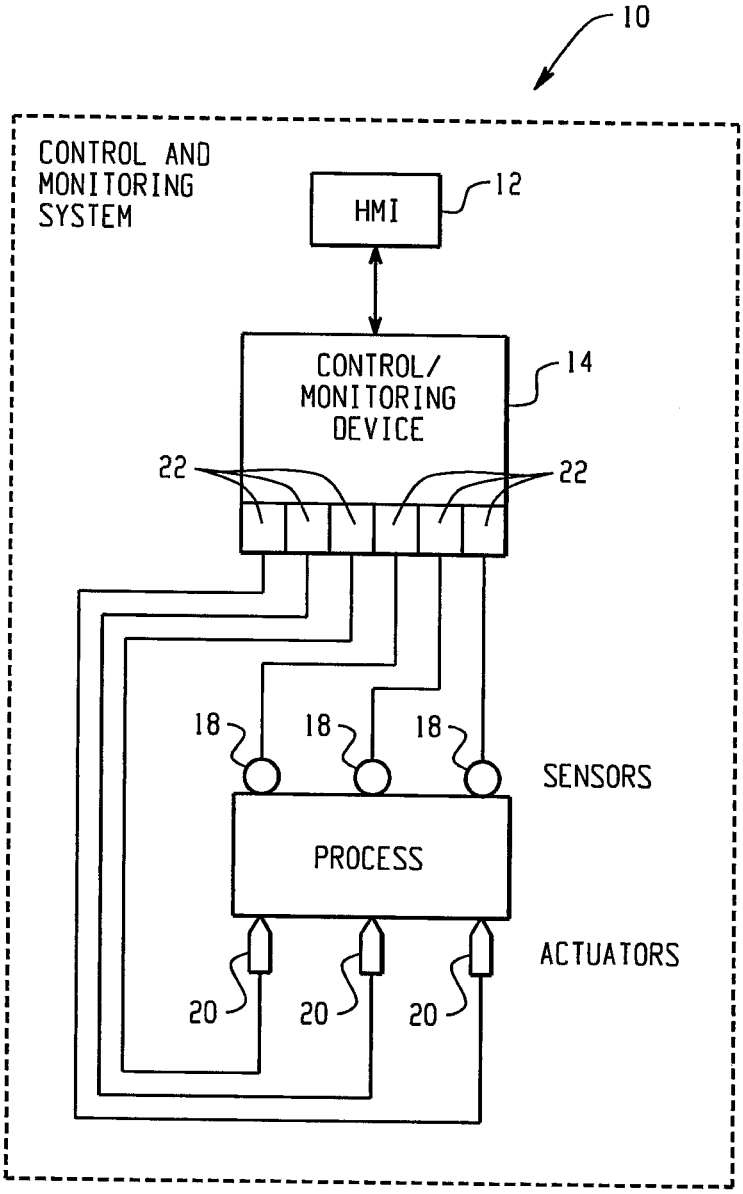
FIG. 1 is a schematic diagram of an exemplary control and monitoring system.

With reference to FIG. 1, a diagrammatical representation is shown of an exemplary control and monitoring system adapted to interface with networked components and configuration equipment in accordance with embodiments of the present techniques. The control and monitoring system is generally indicated by reference numeral 10. Specifically, the control and monitoring system 10 is illustrated as including a human machine interface (HMI) 12 and an automation controller or control/monitoring device 14 adapted to interface with components of a process 16. It should be noted that such an interface in accordance with embodiments of the present techniques may be facilitated by the use of certain network strategies. Indeed, an industry standard network may be employed, such as DeviceNet, to enable data transfer. Such networks permit the exchange of data in accordance with a predefined protocol, and may provide power for operation of networked elements.

The process 16 may take many forms and include devices for accomplishing many different and varied purposes. For example, the process 16 may comprise a compressor station, an oil refinery, a batch operation for making food items, a mechanized assembly line, and so forth. Accordingly, the process 16 may comprise a variety of operational components, such as electric motors, valves, actuators, temperature elements, pressure sensors, or a myriad of manufacturing, processing, material handling, and other applications. Further, the process 16 may comprise control and monitoring equipment for regulating process variables through automation and/or observation.

For example, the illustrated process 16 comprises sensors 18 and actuators 20. The sensors 18 may comprise any number of devices adapted to provide information regarding process conditions. The actuators 20 may include any number of devices adapted to perform a mechanical action in response to a signal from a controller (e.g., an automation controller). The sensors 18 and actuators 20 may be utilized to operate process equipment. Indeed, they may be utilized within process loops that are monitored and controlled by the control/monitoring device 14 and/or the HMI 12. Such a process loop may be activated based on process inputs (e.g., input from a sensor 18) or direct operator input received through the HMI 12.

As illustrated, the sensors 18 and actuators 20 are in communication with the control/monitoring device 14 and may be assigned a particular address in the control/monitoring device 14 that is accessible by the HMI 12. The sensors 18 and actuators 20 may communicate with the control/monitoring device 14 via one or more I/O devices 22 coupled to the control/monitoring device 14. The I/O devices 22 may transfer input and output signals between the control/monitoring device 14 and the controlled process 16. The I/O devices 22 may be integrated with the control/monitoring device 14, or may be added or removed via expansion slots, bays or other suitable mechanisms. For example, as described in greater detail below, additional I/O devices 22 may be added to add functionality to the control/monitoring device 14. Indeed, if new sensors 18 or actuators 20 are added to control the process 16, additional I/O devices 22 may be added to accommodate and incorporate the new features functionally with the control/monitoring device 14. The addition of I/O devices 22 may include disassembly of components of the I/O devices 22. It should be noted that the I/O devices 22 serve as an electrical interface to the control/monitoring device 14 and may be located proximate or remote from the control/monitoring device 14, including remote network interfaces to associated systems.

The I/O devices 22 may include input modules that receive signals from input devices such as photo-sensors and proximity switches, output modules that use output signals to energize relays or to start motors, and bidirectional I/O modules, such as motion control modules which can direct motion devices and receive position or speed feedback. In some embodiments, the I/O devices 22 may convert between AC and DC analog signals used by devices on a controlled machine or process and DC logic signals used by the control/monitoring device 14. Additionally, some of the I/O devices 22 may provide digital signals to digital I/O devices and receive digital signals from digital I/O devices. Further, in some embodiments, the I/O devices 22 that are used to control machine devices or process control devices may include local microcomputing capability on an I/O module of the I/O devices 22.

In some embodiments, the I/O devices 22 may be located in close proximity to a portion of the control equipment, and away from the remainder of the control/monitoring device 14. In such embodiments, data may be communicated with remote modules over a common communication link, or network, wherein modules on the network communicate via a standard communications protocol. Many industrial controllers can communicate via network technologies such as Ethernet (e.g., IEEE802.3, TCP/IP, UDP, EtherNet/IP, and so forth), ControlNet, DeviceNet or other network protocols (Foundation Fieldbus (H1 and Fast Ethernet) Modbus TCP, Profibus) and also communicate to higher level computing systems.

Figure 2:
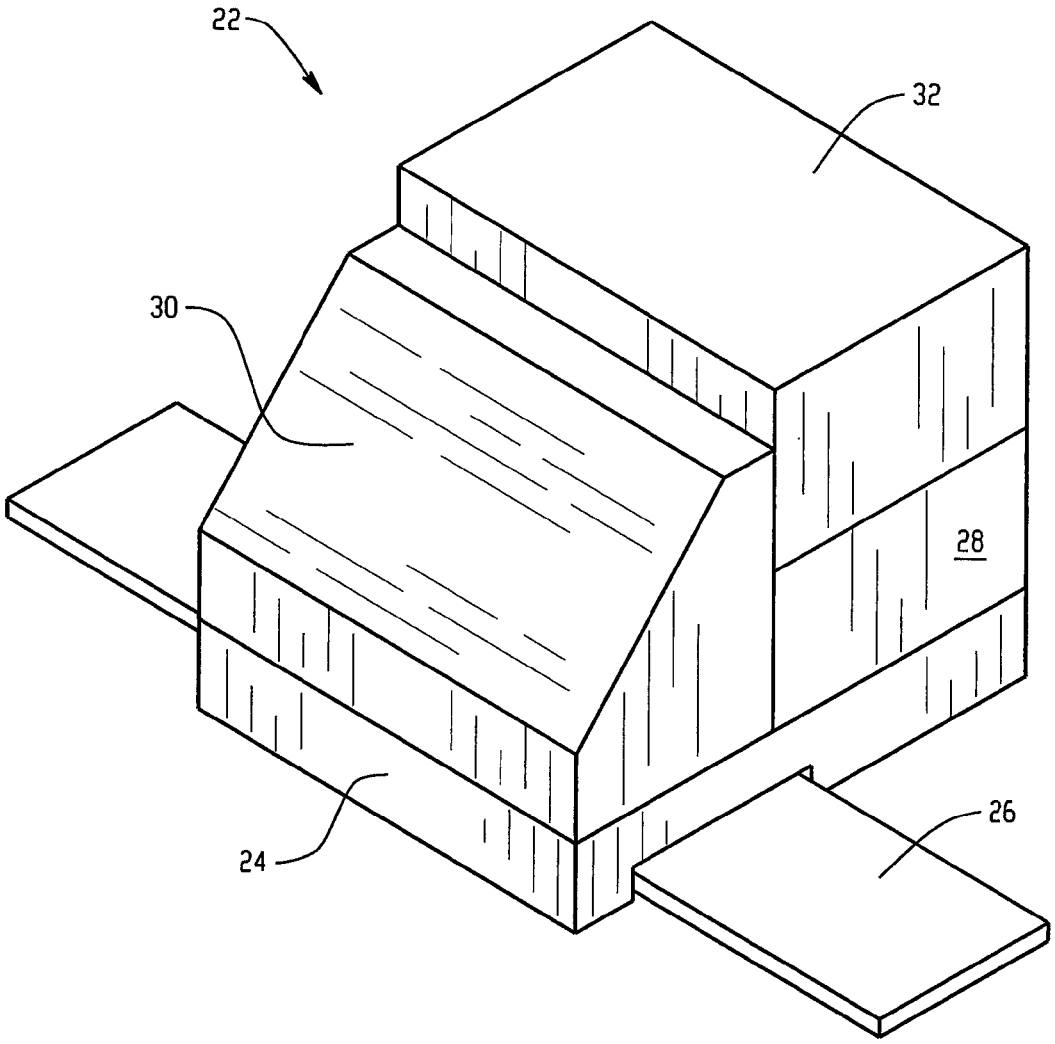
FIG. 2 is a perspective view of an exemplary system in accordance with the present disclosure.
Figure 3:
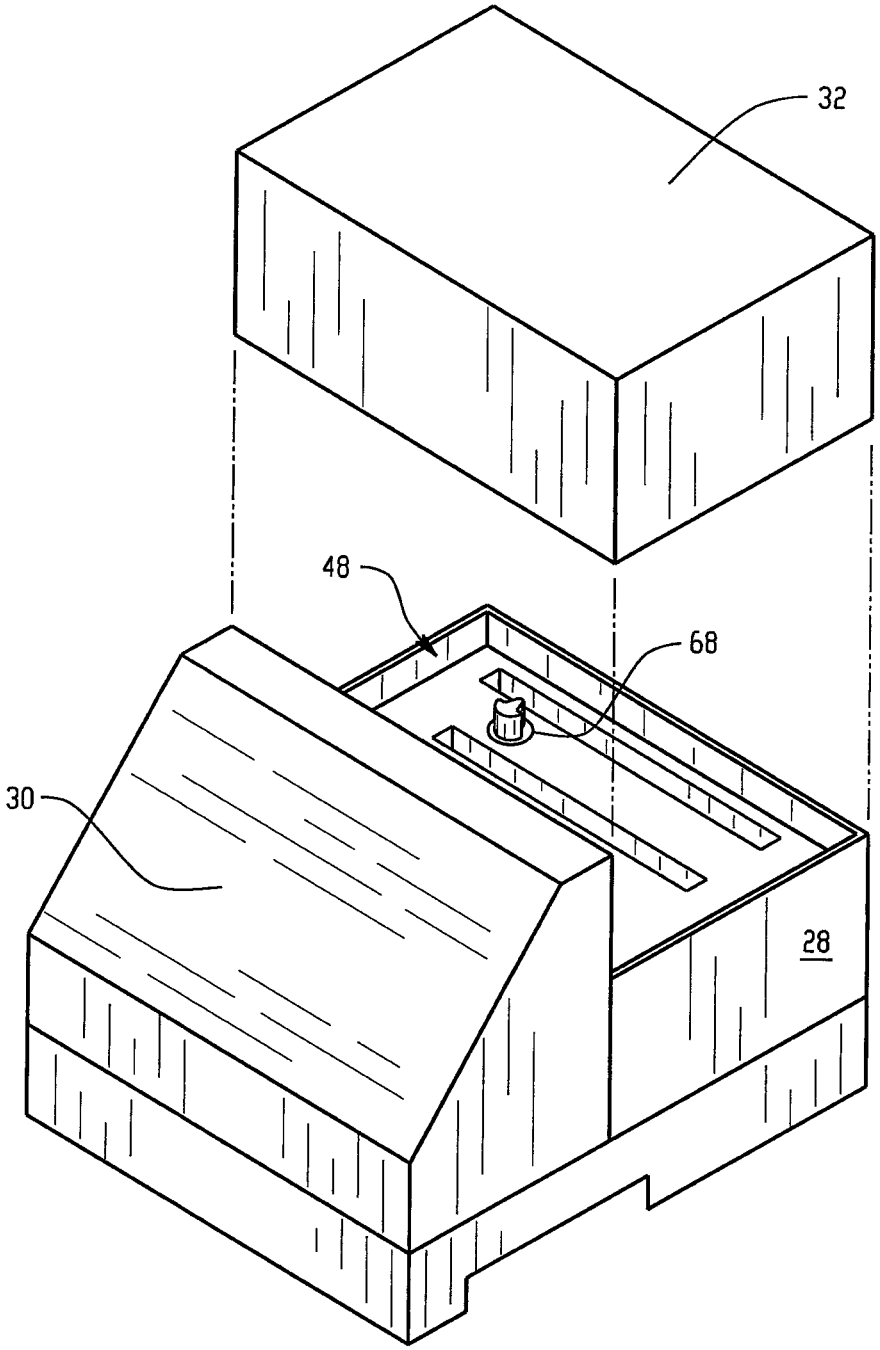
FIG. 3 is a partially exploded view of FIG. 2.

Turning to FIGS. 2 and 3 an exemplary I/O device 22 is illustrated connected to an I/O adapter 24 in accordance with embodiments of the present disclosure. The I/O adapter 24 is configured to provide system power to the I/O module 22, as well as to enable conversion between the communications protocols of the I/O device 22 and the control/monitoring device 14. As illustrated, the I/O adapter 24 and the I/O devices 22 are mounted to a DIN rail 26, which is an industry standard support rail for mounting control equipment in racks and cabinets. It will be appreciated that, although not shown, a plurality of I/O devices can be mounted to one or more I/O adapters on the DIN rail 26, as in conventional. Each of said plurality of I/O devices can be electronically coupled to each other. In this regard, the plurality of I/O devices 22 can be electrically coupled in series along the DIN rail 26 such that field power and system information and power may be communicated between the I/O devices 22, and back through the I/O adapter 24 to the control/monitoring device 14. In other embodiments, the DIN rail 26 may be replaced with a different type of mounting structure.

The I/O device 22 includes a base 28 for physically and communicatively connecting the I/O device 22 to the DIN rail 26, the I/O adapter 24 and/or adjacent I/O devices 22. In addition, the I/O device 22 includes a terminal block 30 (which, in certain embodiments, may be removable from the base 28) for electrically connecting the I/O device 22 to field devices, such as the sensors 18 and actuators 20 illustrated in FIG. 1. Furthermore, the I/O device 22 includes one or more I/O modules 32, which include I/O control circuitry and/or logic. In general, the I/O module 32 receives input signals from the field devices, delivers output signals to the field devices, performs general and/or specific local functionality on the inputs and/or outputs, communicates the inputs and/or outputs to the control/monitoring device 14 and/or other I/O devices, and so forth.

In FIG. 3, the I/O module 32 is shown disconnected from the base 28, which is itself removed from DIN rail 26. It will be appreciated that that I/O module 32 can be coupled to the base 28, both mechanically and electrically, by inserting the I/O module 32 into a mating receptacle 48 of the base 28. When the I/O module 32 is inserted into the receptacle 48 of the base 28, the I/O module 32 becomes electrically coupled to the terminals of the terminal block 30 via internal circuitry within the base 28. As such, the terminal block 30, the base 28, and the I/O module 32 are all electrically and communicatively coupled together such that signals to and from the field device to which the I/O device 22 is connected can be shared between the terminal block 30, the base 28, and the I/O module 32.

In addition, the I/O device 22 may also be electrically coupled to an I/O adapter electrically upstream, and/or other I/O devices electrically upstream or electrically downstream via electrical coupling features of the I/O device 22, as mentioned above.

In certain embodiments, adjacent I/O devices 22 may be mechanically attached to each other via one or more connection features (e.g., slots, tabs interlocks, etc.). In certain embodiments, connection features of an I/O device 22 may slide into mating connection features of an adjacent I/O device 22, thereby physically attaching the adjacent I/O devices 22.

As described above and illustrated in FIG. 3, in certain embodiments, the base 28, terminal block 30, and I/O module 32 of the I/O device 22 may be separate components that may be physically, electrically, and communicatively coupled and decoupled from each other as needed. For example, in certain embodiments where the terminal block 30 is a removable terminal block 30, the terminal block 30 may be removed from the base 28 of the I/O device 22 to investigate connections between the base 28 and the terminal block 30 without disturbing the connection of field wires from the field device to which the I/O device 22 is connected. As another example, different I/O modules 32 may be inserted into the base 28 of the I/O device 22 to provide different levels of I/O functionality. For example, certain I/O modules 32 may provide general functionality, such as receiving signals from the field device to which the I/O device 22 is connected, transmitting the received signals to an automation controller (e.g., the control/monitoring device 14 of FIG. 1), receiving control signals from the automation controller, and transmitting the control signals to the field device. However, other I/O modules 32 may provide more specific functionality, such as performing specific operations on the signals that are received from the field device, the automation controller, and so forth. For example, certain I/O modules 32 may include specific software for performing specific operations relating to particular types of equipment, particular industry applications, particular local control functions (e.g., performed within the I/O module 32), and so forth. Therefore, although the bases 28 of adjacent I/O devices 22 may remain attached to each other and/or the DIN rail 26 during operation of the I/O devices 22, the terminal blocks 30 and/or I/O modules 32 of the I/O devices 22 may often be removed and re-inserted for diagnostics and troubleshooting of one or more I/O devices 22 and/or for changing the functionality of one or more of the I/O devices 22. Indeed, this is an advantageous aspect of the modular nature of the terminal blocks 30 and the I/O modules 32 illustrated in FIGS. 2 and 3.

Occasionally during maintenance, more than one terminal block 30 and/or I/O module 32 are removed from a series of interconnected I/O devices 22. As such, when the terminal blocks 30 and the I/O modules 32 are re-assembled together, a terminal block 30 and/or I/O module 32 may be inadvertently re-inserted into a base 28 to which the terminal block 30 and/or I/O module 32 is not associated, which can lead to unexpected control issues if not addressed. Additional details of I/O devices can be found in U.S. Pat. No. 8,628,004, which is hereby incorporated herein by reference in its entirety.

Figure 4:
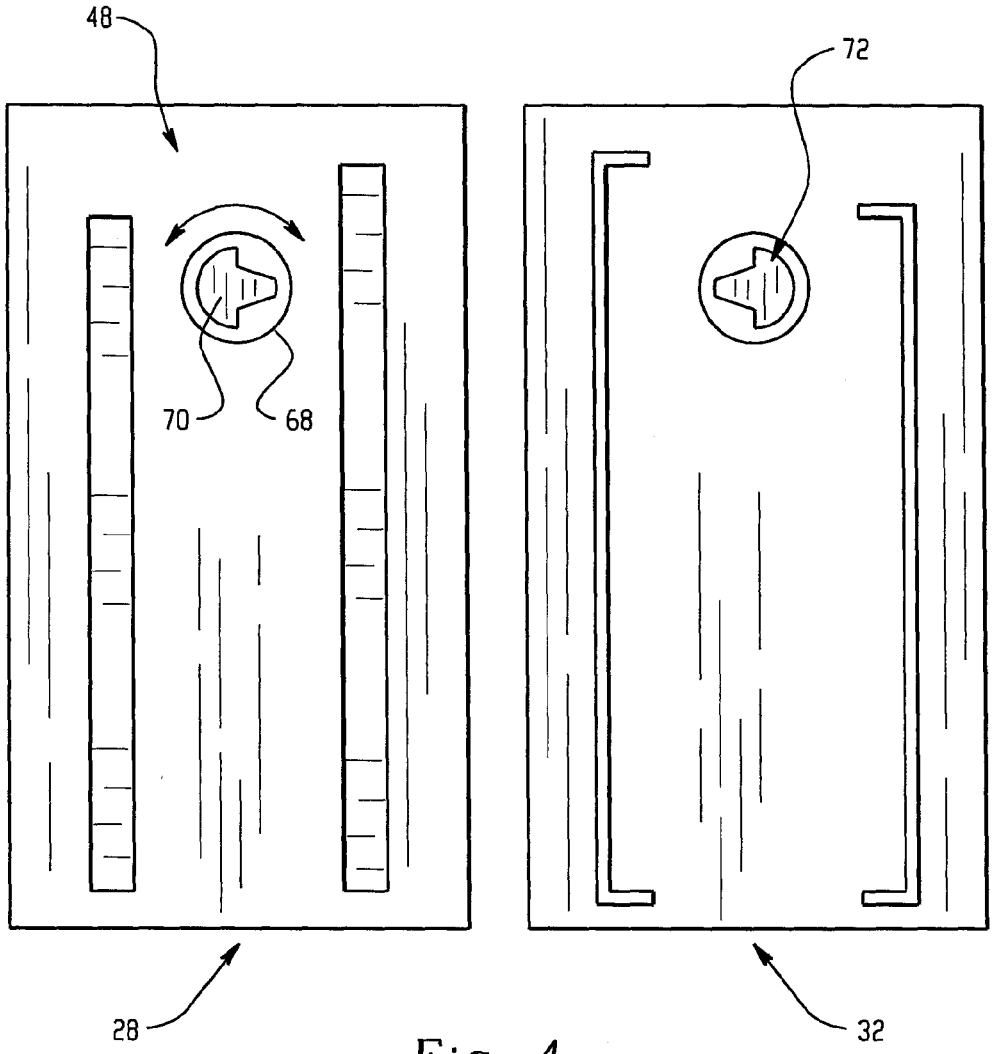
FIG. 4 is a plan view of components of the exemplary system of FIG. 2.

Turning to FIG. 4, and in accordance with the present disclosure, mating mechanical features of the I/O modules 32 and bases 28 mechanically prohibit or restrict certain modules 32 from being inserted into certain bases 28. For example, as illustrated in FIG. 4, the base 28 may include a mechanical keying feature in the form of a cylindrical male key 68 positioned in a bottom of the recess 48 of the base 28. The cylindrical male key 68 includes a protrusion 70 having a cross-sectional shape that maximizes interference with a mating female key slot 72 in the back of the I/O module 32, when the male and female key components are misaligned, as compared to prior art key elements. An axial face 73 of the cylindrical male key 68 includes a plurality of markings 74 indicating a rotational position of the male key 68 when aligned with a corresponding mark 75 on the base 28.

The cylindrical male key 68 of the base 28 illustrated in FIG. 4 can be rotatable, for example, between ten (or more) rotational positions. In some embodiments, the mating female key slot 72 in the back of the associated I/O module 32 may similarly rotate between ten (or more) rotational positions. As such, the base 28 and associated I/O module 32 may be set to the same rotational positions such that the I/O module 32 may be physically inserted into its associated base 28, but not into bases that are set to the other nine rotational positions. In some embodiments, one of the male key 68 or female key slot 72 can be fixed in a given position, and the other key can be rotatable to accommodate more than one key slot position for use with various modules having various key configurations.

Figure 5:
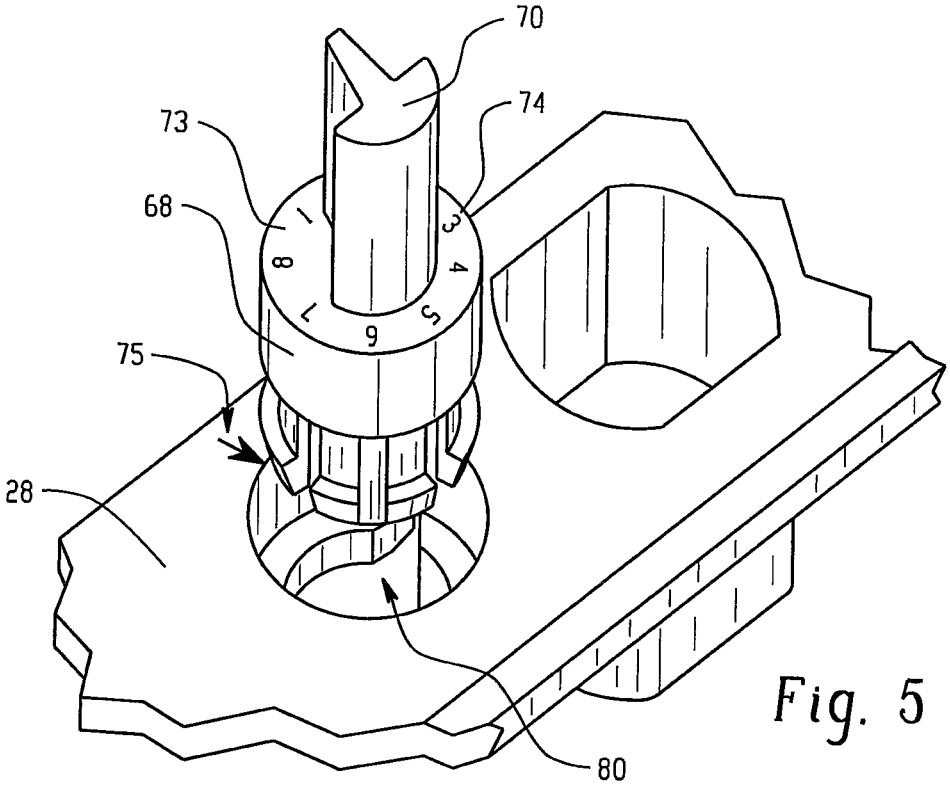
FIG. 5 is a perspective view of an exemplary male key component in accordance with the present disclosure.
Figure 6:
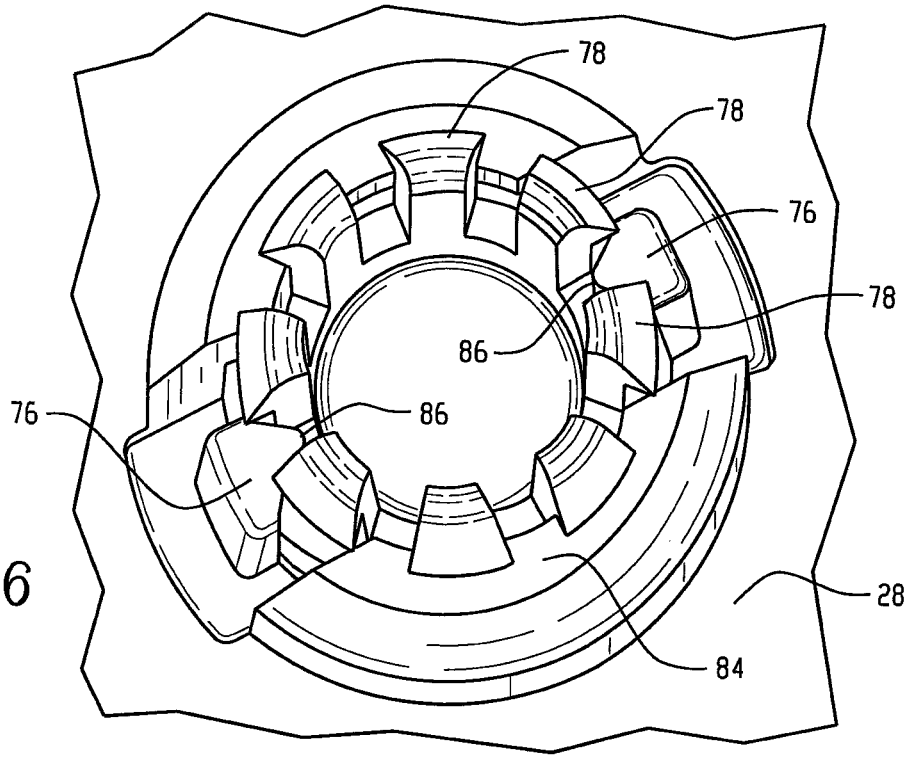
FIG. 6 is a perspective view of the male key component of FIG. 6 installed in base.

With reference to FIGS. 5 and 6, to facilitate the rotation of the male key 68, for example, flexible detents 76 of the base 28 cooperate with a plurality of tangs 78 to restrict rotation of the male key 68 within recess 80 of the base 28. That is, male key 68 includes a plurality of circumferentially spaced retention tangs 78 that snap fit against retention flange 84 to retain male key 68 in the recess 80. Flexible detents 76 engage within the gaps between adjacent retention tangs 78. The gaps are aligned with a specific position of the male key 68 such that by way of interference, the flexible detents 76 restrict rotation of the male key 68 from a given rotational position. It will be appreciated, however, that upon application of sufficient torque to the male key 68, the angled terminal ends 86 act as ramps and urge the flexible detents 76 radially outwardly until the flexible detents are no longer engaged within the gaps between adjacent retention tangs 78 thereby allowing rotation of the male key 68. As the flexible detents 76 move into each gap between adjacent retention tangs 78, an audible click can be produced to signal seating of the flexible detents 76.

Figure 7A:
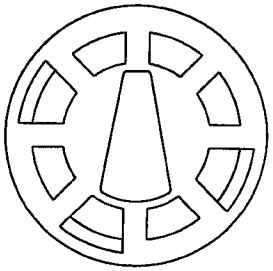
FIGS. 7(*a*)-7(*c*) illustrate various key cross-sectional shapes and corresponding interference surface areas.
Figure 7B:
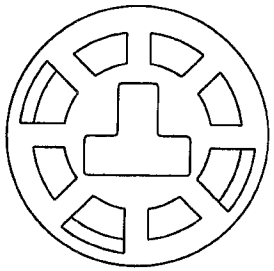
Figure 7C:
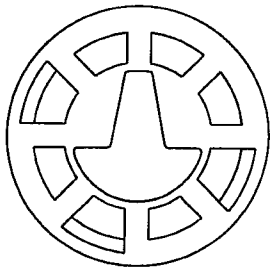

As noted above, the unique cross-sectional shape of the mating male and female key maximizes interference in non-mating orientations as compared to other conventional shapes. With reference to FIG. 7, three different cross-sectional shapes (a), (b) and (c) of an 8-position rotatable male key are shown along with the corresponding interference surface area for each of seven non-mating positions. Cross-sectional shape (a) corresponds to a general wedge shape, while cross-sectional shape (b) corresponds to a general T-shape. As shown in the corresponding tables, cross-sectional shape (a) has at least one position where the interference ratio is 0.08 (male key position 5) while cross-sectional shape (b) has at least two positions wherein the interference area ration is 0.08. (male key positions 4 and 6). It has been found that an interference ration of 0.08 or less is easily defeated. That is, the mating male and female keys do not provide a suitable level of resistance to prevent installation of a given I/O module to a given base when in such a configuration.

It has also been found that an interference between the two mating halves of the keys of greater than about 15% provides an adequate level of resistance to prevent installation of a given I/O module to a given base to effectively prevent a user from defeating the keying system. In contrast to the cross-sectional shapes (a) and (b), the cross-sectional shape (c) of the male and female keys in accordance with the present disclosure has a minimum interference ration of 0.23. This level of interference greatly increases the level of resistance and therefore is more effective at preventing installation of a given I/O module to a given base when in non-mating configurations.

Figure 8:
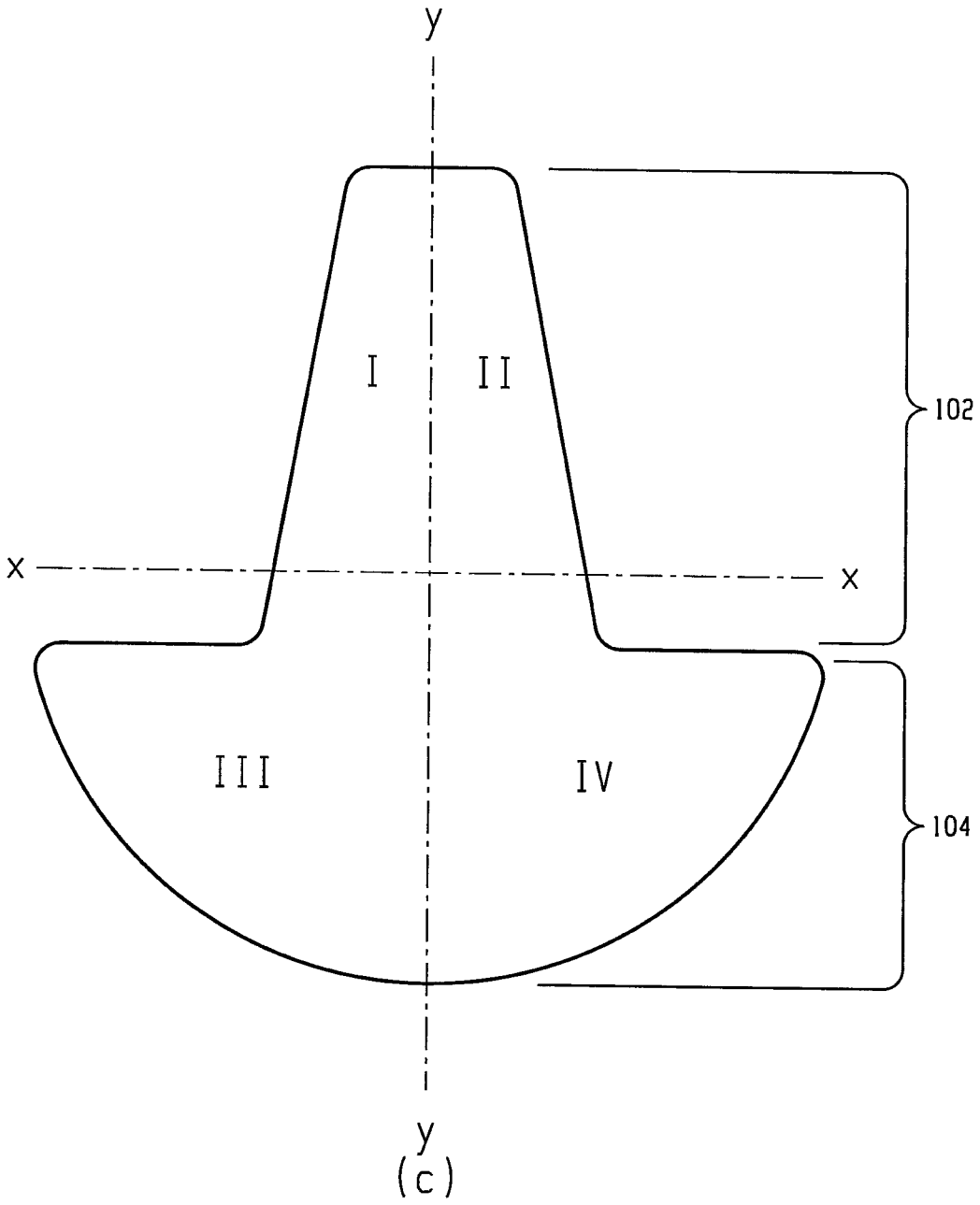
FIG. 8 is an illustration of an exemplary cross-sectional shape for a key in accordance with the present disclosure.

FIG. 8 is an enlarged view of the cross-sectional shape (c). For purposes of this description, a vertical midpoint axis Y and a horizontal midpoint axis X are illustrated bisecting the cross-sectional shape into four quadrants I, II, III, and IV. The cross-sectional shape (c) can be generally described as including a wedge portion 102 and a radius portion 104. The wedge portion 102 extends along the vertical midpoint axis Y to a point beyond the horizontal midpoint axis X where it meets the radius portion 104. Accordingly, the wedge portion resides in quadrants I, II, III, and IV, while the radius portion resides in quadrants III and IV. In addition, the cross-sectional shape (c) is generally symmetrical about the vertical midpoint axis Y. It will be appreciated that the female key slot has a corresponding mating configuration to the cross-sectional shape shown and described in FIG. 8.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system comprising:

a base mountable to a rail, the base including a receptacle for receiving an input/output (I/O) module; and an (I/O) module attachable to the base, the I/O module including communication circuitry disposed within a housing of the I/O module configured to communicate, via a terminal block, with one or more field devices configured to monitor and/or control an industrial automation process;

wherein the base and I/O module include mating male and female components; and wherein the mating male and female components have a cross-sectional shape having a wedge portion and a radius portion, the wedge portion extending from the radius portion, the wedge portion having an axial extent along a midpoint axis bisecting both the wedge portion and the radius portion that is greater than an axial extent of the radius portion along the midpoint axis;

wherein the male component includes a cylindrical base, and a protrusion extending from the cylindrical base having the cross-sectional shape having the wedge portion and the radius portion, the protrusion having a cross-sectional area that is less than a cross-sectional area of the cylindrical base, the wedge portion being spaced radially inwardly from a peripheral circumference of the cylindrical base.

2. The system of claim 1, wherein the cross-sectional shape is symmetrical about the midpoint axis bisecting the wedge portion and the radius portion.

3. The system of claim 1, wherein the male components is supported by the base and the female component is supported by the I/O module, and at least one of the male or female components is rotatable relative to the base or I/O module in by which it is supported.

4. The system of claim 3, wherein the at least one male or female component that is rotatable is rotatable to eight discrete angular positions.

5. The system of claim 4, wherein seven of the eight discrete angular positions correspond to interference positions, each of the seven interference positions having an interference ratio of at least 0.23.

6. The system of claim 3, wherein the at least one male or female component that is rotatable includes a plurality of retention tangs adapted to cooperate with the base or I/O module to retain said component therein, and wherein the base or I/O module includes a detent adapted to be received between adjacent retention tangs to restrict rotation of said component.

7. The system of claim 6, wherein the detent includes a flexible detent, the flexible detent configured to flex radially outwardly to permit rotation of said component when sufficient torque is applied thereto.

8. A system comprising:

a base mountable to a rail, the base including a receptacle for receiving an input/output (I/O) module; and an (I/O) module attachable to the base, the I/O module including communication circuitry disposed within a housing of the I/O module configured to communicate, via a terminal block, with one or more field devices configured to monitor and/or control an industrial automation process;

wherein the base and I/O module include mating male and female components;

wherein the mating male and female components have a cross-sectional shape having a wedge portion and a radius portion, the wedge portion extending along a major portion of a midpoint axis bisecting the wedge portion and the radius portion;

wherein the male component includes a cylindrical base, and a protrusion extending from the cylindrical base having the cross-sectional shape having the wedge portion and the radius portion; and wherein the cylindrical base includes an axial face having a plurality of markings surrounding the protrusion, the plurality of marking corresponding to a number of discrete angular positions of the male component.

9. A key system for control system components comprising mating male and female components, each of the male and female components being associated with a respective control system component, wherein the mating male and female components have a cross-sectional shape having a wedge portion and a radius portion, the wedge portion extending along a major portion of a midpoint axis bisecting the wedge portion and the radius portion, wherein the male key component includes a cylindrical base, and a protrusion extending from the cylindrical base having the cross-sectional shape having the wedge portion and the radius portion, and wherein the cylindrical base includes an axial face having a plurality of markings surrounding the protrusion, the plurality of marking corresponding to a number of discrete angular positions of the male component.

10. The key system of claim 9, wherein the cross-sectional shape is symmetrical about the midpoint axis bisecting the wedge portion and the radius portion.

11. The key system of claim 9, wherein the male component is rotatable relative to the control system component with which it associated.

12. The key system of claim 11, wherein the male component is rotatable to eight discrete angular positions.

13. The key system of claim 12, wherein seven of the eight discrete angular positions correspond to interference positions, each of the seven interference positions having an interference ratio of at least 0.23.

14. The key system of claim 9, wherein the male component is generally cylindrical and includes a plurality of circumferentially-spaced retention tangs adapted to cooperate with the associated control system component to retain the male component therein.

15. The key system of claim 14, wherein the male key component includes at least one gap between adjacent circumferentially-spaced retention tangs, the gap adapted to receive a detent of the associated control system component to restrict rotation of said male component.

16. The key system of claim 15, wherein rotation of the male key component urges the detent radially outwardly to permit rotation of the male key when sufficient torque is applied thereto.

17. A method comprising:

providing a first control system component having a rotatable male key with a cross-sectional shape having a wedge portion and radius portion, the wedge portion having an axial extent along a midpoint axis bisecting both the wedge portion and the radius portion that is greater than an axial extent of the radius portion along the midpoint axis, wherein the male key includes a cylindrical base, and a protrusion extending from the cylindrical base having the cross-sectional shape having the wedge portion and the radius portion, the protrusion having a cross-sectional area that is less than a cross-sectional area of the cylindrical base, the wedge portion being spaced radially inwardly from a peripheral circumference of the cylindrical base;

providing a second control system component having a fixed female key slot for receiving the male key of the first control system component when the first and second control system components are coupled;

rotating the male key to match an angular position of the female key slot; and coupling the first and second control system components.

* * * * *